US008910468B2

(12) United States Patent
Obayashi et al.

(10) Patent No.: US 8,910,468 B2
(45) Date of Patent: Dec. 16, 2014

(54) EXHAUST GAS TREATMENT CATALYST, EXHAUST GAS TREATMENT METHOD, AND EXHAUST GAS TREATMENT APPARATUS

(75) Inventors: Yoshiaki Obayashi, Hiroshima (JP); Katsumi Nochi, Hiroshima (JP); Toshio Koyanagi, Nagasaki (JP); Chris E. Difrancesco, Durham, NC (US)

(73) Assignees: Mitsubishi Heavy Industries, Ltd., Tokyo (JP); Cormetech, Inc., Durham, NC (US)

( * ) Notice: Subject to any disclaimer, the term of this patent is extended or adjusted under 35 U.S.C. 154(b) by 567 days.

(21) Appl. No.: 12/365,366

(22) Filed: Feb. 4, 2009

(65) Prior Publication Data

US 2010/0192552 A1 Aug. 5, 2010

(51) Int. Cl.
*F01N 3/10* (2006.01)
*F01N 3/22* (2006.01)

(52) U.S. Cl.
CPC .. *F01N 3/10* (2013.01); *F01N 3/22* (2013.01); *F01N 2570/04* (2013.01)
USPC ..... 60/299; 60/274; 60/286

(58) Field of Classification Search
USPC ..... 60/274, 284–287, 295–301
See application file for complete search history.

(56) References Cited

U.S. PATENT DOCUMENTS

| | | | | |
|---|---|---|---|---|
| 2,204,543 | A * | 6/1940 | Berl | 423/531 |
| 4,003,978 | A * | 1/1977 | Shiraishi et al. | 423/237 |
| 4,952,545 | A * | 8/1990 | Imanari et al. | 502/73 |
| 5,371,055 | A * | 12/1994 | Cormier et al. | 502/65 |
| 5,417,947 | A * | 5/1995 | Hertl et al. | 423/212 |
| 5,492,883 | A * | 2/1996 | Wu | 502/439 |
| 5,676,912 | A * | 10/1997 | Sharma et al. | 423/213.2 |
| 6,093,378 | A * | 7/2000 | Deeba et al. | 423/213.5 |
| 6,150,291 | A * | 11/2000 | Deeba et al. | 502/60 |
| 6,372,685 | B1 * | 4/2002 | Pecoraro et al. | 502/232 |
| 6,503,469 | B2 * | 1/2003 | Izumi et al. | 423/210 |
| 6,649,133 | B1 * | 11/2003 | Hasegawa et al. | 423/239.1 |
| RE39,041 | E * | 3/2006 | Nojima et al. | 423/237 |
| 7,081,434 | B2 * | 7/2006 | Sinha | 502/400 |
| 7,150,861 | B2 * | 12/2006 | Morita et al. | 423/213.5 |
| 7,211,540 | B2 * | 5/2007 | Nakanishi et al. | 502/309 |
| 7,842,644 | B2 * | 11/2010 | Kai et al. | 502/311 |
| 2003/0039597 | A1 * | 2/2003 | Deeba et al. | 422/177 |
| 2003/0092858 | A1 * | 5/2003 | Pecoraro et al. | 526/129 |
| 2004/0168433 | A1 * | 9/2004 | Nojima et al. | 60/301 |

(Continued)

FOREIGN PATENT DOCUMENTS

| | | | |
|---|---|---|---|
| JP | 8-309152 | A | 11/1996 |
| JP | 10-249163 | A | 9/1998 |
| JP | 11-267459 | A | 10/1999 |
| JP | 2004-255342 | A | 9/2004 |

(Continued)

OTHER PUBLICATIONS

Japanese Office Action dated Mar. 29, 2011, issued in corresponding Japanese Patent Application No. 2009-197729.

*Primary Examiner* — Jesse Bogue
(74) *Attorney, Agent, or Firm* — Westerman, Hattori, Daniels & Adrian, LLP

(57) ABSTRACT

An exhaust gas treatment catalyst for removal of one or more pollutants in an exhaust gas, the catalyst comprising: a $SO_3$-reducing catalyst powder which removes the above-described pollutants; and a diluent powder which is not the $SO_3$-reducing catalyst powder nor a catalyst for reactions between exhaust gas components and a reagent, wherein the $SO_3$-reducing catalyst powder is dispersed in the diluent powder.

11 Claims, 4 Drawing Sheets

(56) References Cited

U.S. PATENT DOCUMENTS

| | | | | |
|---|---|---|---|---|
| 2005/0284139 | A1* | 12/2005 | Verkiel et al. | 60/297 |
| 2006/0083671 | A1* | 4/2006 | Obayashi et al. | 423/239.1 |
| 2008/0227625 | A1* | 9/2008 | Stockwell | 502/34 |

FOREIGN PATENT DOCUMENTS

| | | | | |
|---|---|---|---|---|
| JP | 2005-118687 | A | 5/2005 | |
| JP | 2006-136869 | A | 6/2006 | |
| WO | WO2008035773 | A1 * | 3/2008 | B01J 23/30 |

* cited by examiner

EXHAUST GAS TREATMENT CATALYST, EXHAUST GAS TREATMENT METHOD, AND EXHAUST GAS TREATMENT APPARATUS

BACKGROUND OF THE INVENTION

1. Field of the Invention

The present invention relates to an exhaust gas treatment catalyst for removal of one or more pollutants in an exhaust gas, an exhaust gas treatment method, and an exhaust gas treatment apparatus for removal of one or more pollutants in exhaust gas.

2. Description of the Related Art

An ammonia catalytic reduction method, in which $NO_X$ is decomposed into harmless nitrogen and water by ammonia ($NH_3$) serving as a reducing agent in the presence of a nitrogen oxide removal catalyst (hereafter referred to as "a denitration catalyst"), has been in practical use as a method for removing nitrogen oxides ($NO_X$) in exhaust gases discharged from boilers, gas turbines, incinerators, and the like.

In some of the above-described boilers and the like, coal, fuel oil C, or the like having a high sulfur content is used as a fuel. High concentrations of sulfur dioxide ($SO_2$) and sulfur trioxide ($SO_3$) are present in exhaust gases resulting from burning of such fuels.

When such an exhaust gas is treated by using the above-described ammonia catalytic reduction method, an oxidation reaction of $SO_2$ to sulfur trioxide ($SO_3$) occurs at the same time with a $NO_X$ reduction and removal reaction, in which $NO_X$ is reduced and removed, and the content of $SO_3$ in the exhaust gas is increased. The resulting $SO_3$ and unreacted $NH_3$, which serves as a reducing agent in the above-described $NO_X$ reduction and removal reaction, are readily bonded to each other in a low temperature region so as to form compounds, e.g., acid ammonium sulfate. The insides and pipes of various apparatuses, e.g., heat exchangers, disposed downstream are corroded by the resulting compounds, e.g., acid ammonium sulfate, and $SO_3$, and clogging, partial blocking, or the like occurs so as to increase the pressure loss.

Consequently, in the case where the above-described exhaust gas is treated, a titania-vanadium-tungsten catalyst or the like is used as a denitration catalyst having excellent denitration performance and low $SO_2$ oxidation performance resistant to occurrence of oxidation reaction of $SO_2$ to $SO_3$.

On the other hand, examples of the above-described exhaust gas treatment catalysts include a catalyst 40, in which the entire catalyst is composed of a powder 41 having $SO_3$ reduction performance, as shown in FIG. 4.

Furthermore, various technologies for reducing the concentration of the above-described sulfur trioxide ($SO_3$) in the exhaust gases have been proposed (for example, Japanese Unexamined Patent Application Publication No. 10-249163, Japanese Unexamined Patent Application Publication No. 11-267459, and Japanese Unexamined Patent Application Publication No. 2006-136869).

However, it is known that the oxidation reaction of $SO_2$ to $SO_3$, on the order of 0.1%, occurs even when the above-described titania-vanadium-tungsten catalyst serving as the denitration catalyst is used. Therefore, acid ammonium sulfate and the like are generated, as described above.

Here, a reaction mechanism in the case where the concentration of $NH_3$ is reduced in the above-described exhaust gas treatment catalyst 40 will be described with reference to FIG. 5. In the drawing, each line represents the concentration of one component in a thickness direction of the catalyst 40 perpendicular to the gas flow. A solid line represents the concentration of $NH_3$, a dotted chain line represents the concentration of $NO_X$, and a two-dot chain line represents the concentration of $SO_3$.

As is clear from FIG. 5, the concentrations of $NH_3$ and $NO_X$ are high on the surface of the catalyst 40, but are decreased with decreasing proximity to the surface so as to become constant. On the other hand, the concentration of $SO_3$ is decreased with decreasing proximity to the surface of the catalyst 40 in the vicinity of the surface, but thereafter, is increased with decreasing proximity to the surface. That is, in the vicinity of the surface of the catalyst 40, a denitration reaction represented by the following formula (1), a $SO_3$ reduction reaction represented by the following formula (2), and a self decomposition reaction of ammonia represented by the following formula (3) are facilitated. Furthermore, in the inside of the catalyst 40, a $SO_3$ formation reaction represented by the following formula (4) is facilitated. Specifically, it was made clear that, in the vicinity of the surface of the catalyst 40, a denitration reaction region S1 and a $SO_3$ reduction reaction region S2 were dominant, while an ammonia self decomposition region was dominant in the same region, whereas merely a $SO_3$ formation reaction S3 was dominant in the inside of the catalyst 40.

$$4NO+4NH_3+O_2 \rightarrow 4N_2+6H_2O \quad (1)$$

$$SO_3+2NH_3+O_2 \rightarrow SO_2+N_2+3H_2O \quad (2)$$

$$4NH_3+3O_2 \rightarrow 2N_2+6H_2O \quad (3)$$

$$2SO_2+O_2 \rightarrow 2SO_3 \quad (4)$$

It is believed that examples of structures suitable for inhibiting the formation of $SO_3$ even when the $NH_3$ concentration is reduced, as described above, include a catalyst 50, as shown in FIG. 6, in which a $SO_3$-reducing catalyst portion 52 having the $SO_3$ reduction performance is disposed on the surface of a base material 51, e.g., cordierite, and a catalyst 60, as shown in FIG. 7, in which a $SO_3$-reducing catalyst portion 62 having the $SO_3$ reduction performance is disposed on the surface of a denitration catalyst 61.

However, with respect to even the catalyst 50 as shown in FIG. 6, since the $SO_3$-reducing catalyst portion 52 is disposed merely in the vicinity of the surface of the base material 51, in the case where an exhaust gas contains ash, the $SO_3$-reducing catalyst portion 52 is abraded by the ash and, thereby, the catalytic performance thereof is degraded. Furthermore, in the case where an exhaust gas contains a poison component, e.g., arsenic, since the components are different between the base material 51 and the $SO_3$-reducing catalyst portion 52, the poison component diffuses into merely the $SO_3$-reducing catalyst portion 52 so as to poison merely the catalyst portion 52.

With respect to even the catalyst 60 as shown in FIG. 7, since the $SO_3$-reducing catalyst portion 62 is disposed merely in the vicinity of the surface, in the case where an exhaust gas contains ash, the $SO_3$-reducing catalyst portion 62 is abraded by the ash and, thereby, the catalytic performance thereof is degraded. Furthermore, in the case where an exhaust gas contains a poison component, e.g., arsenic, since the denitration catalyst 61 and the $SO_3$-reducing catalyst portion 62 contain the same component, the poison component diffuses into the $SO_3$-reducing catalyst portion 62 and the denitration catalyst 61 so as to poison the entire catalyst 60.

The above-described problems occur with respect to not only catalysts which facilitate a reduction reaction of sulfur trioxide and reduction reactions of nitrogen oxides, but also exhaust gas treatment catalysts, such as $NO_X$-reducing catalysts and $SO_X$-reducing catalysts, which remove one or more pollutants in an exhaust gas.

The present invention has been proposed in consideration of the above-described circumstances. Accordingly, it is an object of the invention to provide an exhaust gas treatment catalyst, an exhaust gas treatment method, and an exhaust gas treatment apparatus, in which the performance degradation due to abrasion and poisoning is suppressed.

SUMMARY OF THE INVENTION

A first aspect of the present invention is an exhaust gas treatment catalyst for removal of one or more pollutants in an exhaust gas, the catalyst comprising: a catalytic component which removes the above-described pollutants; and a diluent component which is not a catalyst for exhaust gas reactions nor a catalyst for reactions between exhaust gas components and a reagent, wherein the above-described catalytic component is dispersed in the above-described diluent component.

A second aspect of the present invention is the exhaust gas treatment catalyst according to the first aspect, wherein the above-described catalytic component reduces sulfur trioxide with an ammonia reagent.

A third aspect of the present invention is the exhaust gas treatment catalyst according to the second aspect, wherein the catalytic component comprises titania-tungsten oxide or silica and ruthenium.

A fourth aspect of the present invention is the exhaust gas treatment catalyst according to the third aspect, wherein ruthenium is 0.1 parts by weight or more, and 10 parts by weight or less relative to 100 parts by weight of titania-tungsten oxide or silica.

A fifth aspect of the present invention is the exhaust gas treatment catalyst according to any one of the first aspect to the fourth aspect, wherein the diluent component is silica.

A sixth aspect of the present invention is the exhaust gas treatment catalyst according to any one of the first aspect to the fourth aspect, wherein the content of the catalytic component is 1% or more, and 50% or less.

A seventh aspect of the present invention is the exhaust gas treatment catalyst according to the fifth aspect, wherein the content of the catalytic component is 1% or more, and 50% or less.

A eighth aspect of the present invention is an exhaust gas treatment method for removing nitrogen oxides and sulfur trioxide contained in an exhaust gas, the method comprising the step of: allowing the exhaust gas after addition of ammonia to come into contact with the exhaust gas treatment catalyst according to the third aspect, so as to reduce the sulfur trioxide and reduce the nitrogen oxides.

An ninth aspect of the present invention is an exhaust gas treatment apparatus for removing nitrogen oxides and sulfur trioxide contained in an exhaust gas, wherein the exhaust gas treatment apparatus is disposed in contact with the exhaust gas after addition of ammonia and includes the exhaust gas treatment catalyst according to the third aspect, so as to reduce the sulfur trioxide and reduce the nitrogen oxide through the use of the exhaust gas treatment catalyst.

A tenth aspect of the present invention is the exhaust gas treatment apparatus according to the ninth aspect, wherein the exhaust gas treatment apparatus further comprises a denitration catalyst disposed downstream from the exhaust gas treatment catalyst, so as to further reduce the nitrogen oxides through the use of the denitration catalyst.

The exhaust gas treatment catalyst according to an aspect of the present invention is an exhaust gas treatment catalyst for removal of one or more pollutants in an exhaust gas, and the catalyst comprises a catalytic component which removes the above-described pollutants and a diluent component which is not a catalyst for exhaust gas reactions nor a catalyst for reactions between exhaust gas components and a reagent, wherein the above-described catalytic component is dispersed in the above-described diluent component. Therefore, the abrasion resistance and the poisoning resistance are improved.

In the exhaust gas treatment method according to an aspect of the present invention, ammonia is added to an exhaust gas containing nitrogen oxides and sulfur trioxide, the resulting exhaust gas is allowed to come into contact with the exhaust gas treatment catalyst, so as to reduce the above-described sulfur trioxide and reduce the above-described nitrogen oxides. Therefore, these reduction reactions are effected in the entire catalyst, and formation of sulfur trioxide is inhibited. Furthermore, since the above-described catalytic component is dispersed in the above-described diluent component, the abrasion resistance and the poisoning resistance are improved.

The exhaust gas treatment apparatus according to an aspect of the present invention includes an exhaust gas treatment catalyst disposed in contact with an exhaust gas after addition of ammonia, the exhaust gas containing nitrogen oxides and sulfur trioxide, so as to reduce the above-described sulfur trioxide and reduce the above-described nitrogen oxides through the use of the above-described exhaust gas treatment catalyst. Consequently, the reduction reaction of sulfur trioxide and the reduction reaction of nitrogen oxides are effected in the entire catalyst and, thereby, formation of sulfur trioxide can be inhibited. Furthermore, miniaturization and cost reduction of the exhaust gas treatment apparatus can be facilitated. Moreover, since the above-described catalytic component is dispersed in the above-described diluent component, the abrasion resistance and the poisoning resistance are improved.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAIL DESCRIPTION OF THE INVENTION

A preferred embodiment of an exhaust gas treatment catalyst, an exhaust gas treatment method, and an exhaust gas treatment apparatus according to the present invention will be described in detail with reference to the accompanying drawings.

In the present embodiment, the case where the present invention is applied to a catalyst which facilitates a reduction reaction of sulfur trioxide and reduction reactions of nitrogen oxides will be described below.

Figure 1:
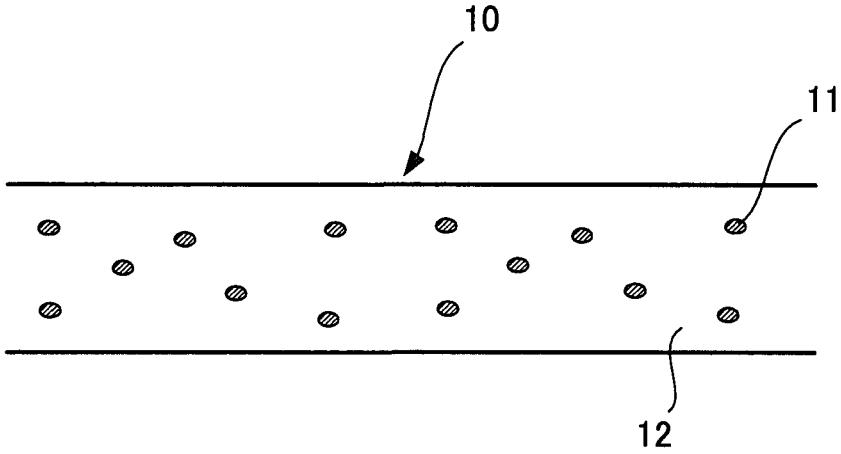
FIG. 1 is a schematic diagram of an exhaust gas treatment catalyst according to a preferred embodiment of the present invention.

As shown in FIG. 1, an exhaust gas treatment catalyst 10 according to the preferred embodiment of the present invention contains a $SO_3$-reducing catalyst powder (catalyst powder) 11 composed of a catalyst component for reducing sulfur trioxide and a diluent powder 12 composed of a diluent component which does not react with exhaust gas components after an ammonium gas is added nor react with the $SO_3$-reducing catalyst powder 11, and the $SO_3$-reducing catalyst powder 11 is dispersed in the diluent powder 12. Examples of the above-described $SO_3$-reducing catalyst powder 11 composed of the catalytic components include a powder composed of titania-tungsten oxide or silica and ruthenium. It is desirable that the above-described diluent powder 12 does not cause adverse reactions nor consumption of ammonia serving as a reagent, and examples thereof include a powder composed of silica. Since the exhaust gas treatment catalyst 10 has the above-described structure, when $NH_3$ serving as a reagent is added to an exhaust gas which is discharged from a boiler, a gas turbine, an incinerator, or the like and which contains sulfur oxides ($SO_X$) and nitrogen oxides ($NO_X$), a reduction reaction of sulfur trioxide (refer to the following formula (5)) is effected in the entire catalyst 10 and, in addition, a reduction reaction of nitrogen oxides (refer to the following formulae (6) and (7)) is effected. Furthermore, a self decomposition reaction of ammonia (refer to the following formula (8)) is mitigated, and a formation reaction of sulfur trioxide (refer to the following formula (9)) is inhibited. Moreover, since the $SO_3$-reducing catalyst powder 11 is dispersed in the diluent powder 12, the abrasion resistance and the poisoning resistance are improved.

$$SO_3+2NH_3+O_2 \rightarrow SO_2+N_2+3H_2O \quad (5)$$

$$4NO+4NH_3+O_2 \rightarrow 4N_2+6H_2O \quad (6)$$

$$NO+NO_2+2NH_3 \rightarrow 2N_2+3H_2O \quad (7)$$

$$4NH_3+3O_2 \rightarrow 2N_2+6H_2O \quad (8)$$

$$2SO_2+O_2 \rightarrow 2SO_3 \quad (9)$$

Ruthenium is specified to be 0.1 parts by weight or more, and 10 parts by weight or less, preferably be 1 part by weight or more, and 4 parts by weight or less relative to 100 parts by weight of titania-tungsten oxide or silica. When such a weight ratio is adopted, the denitration reaction and the reduction reaction of sulfur trioxide can be effected in a balanced manner. In the catalyst powder composed of titania and tungsten oxide, the amount of tungsten oxide is specified to be 0.1 parts by weight or more, and 25 parts by weight or less relative to 100 parts by weight of titania.

The formation reaction of sulfur trioxide (refer to the above-described formula (9)) can be inhibited by specifying the ratio of catalyst component to the exhaust gas treatment catalyst 10 to be within the range of 1% or more, and 50% or less, preferably of 5% or more, and 25% or less.

The above-described $SO_3$-reducing catalyst powder 11 can be produced by mixing a catalyst powder containing titania and tungsten oxide or a silica powder and a ruthenium chloride solution so as to prepare a slurry and subjecting the resulting slurry to spray drying.

The exhaust gas treatment catalyst 10 is produced by for example, kneading a $SO_3$-reducing catalyst powder 11, the diluent powder 12, a glass fiber serving as an inorganic binder, and polyvinyl alcohol serving as an organic binder, molding into a honeycomb structure, drying, for example, at 100° C. for 5 hours (preliminary drying), and firing at 500° C. for 5 hours so as to remove the organic binder.

When a known catalyst, in which the base material surface is coated with a $SO_3$-reducing catalyst having a thickness of 70 μm, is placed in an exhaust gas containing ash for 15,000 hours, the catalyst is abraded by the above-described ash and the thickness thereof becomes 60 μm, so that the catalyst performance is degraded. However, with respect to the above-described exhaust gas treatment catalyst 10, even when the surface of the catalyst 10 is abraded by the ash, the degradation of the catalyst performance can be suppressed because the $SO_3$-reducing catalyst powder 11 is present dispersing in the diluent powder 12.

Co-extrusion of the $SO_3$-reducing catalyst powder 11 and the diluent powder 12 can produce a catalyst with erosion resistance higher than that of a coated catalyst.

Since the costly $SO_3$-reducing catalyst powder 11 can be co-extruded with the diluent powder 12, the manufacturing cost of coating an extruded substrate can be avoided, while the coating is a common practice for costly catalyst components, such as precious metals.

Therefore, according to the above-described exhaust gas treatment catalyst 10, the exhaust gas treatment catalyst for removal of one or more pollutants in the exhaust gas comprises the $SO_3$-reducing catalyst powder 11 which removes the above-described pollutants and the diluent powder 12 which is not a catalyst for exhaust gas reactions nor a catalyst for reactions between the exhaust gas components and the reagent, and the $SO_3$-reducing catalyst powder 11 is dispersed in the diluent powder 12. Consequently, the abrasion resistance and the poisoning resistance are improved. Furthermore, since the exhaust gas treatment catalyst 10 has the above-described configuration and $NH_3$ is added to the exhaust gas, the reduction reaction of sulfur trioxide is effected in the entire catalyst 10 and, in addition, the reduction reaction of nitrogen oxides is effected, so that formation of sulfur trioxide is inhibited.

Figure 2:
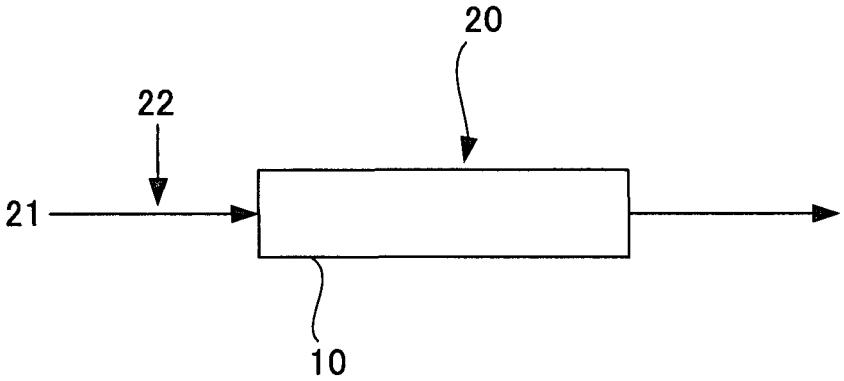
FIG. 2 is a schematic diagram of an exhaust gas treatment apparatus according to an embodiment of the present invention.
Figure 3:
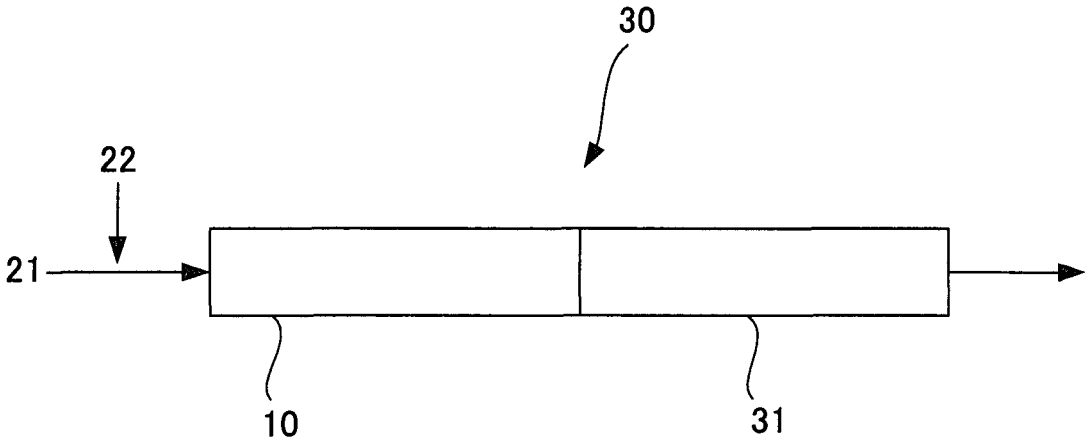
FIG. 3 is a schematic diagram of an exhaust gas treatment apparatus according to another embodiment of the present invention.
Figure 4:
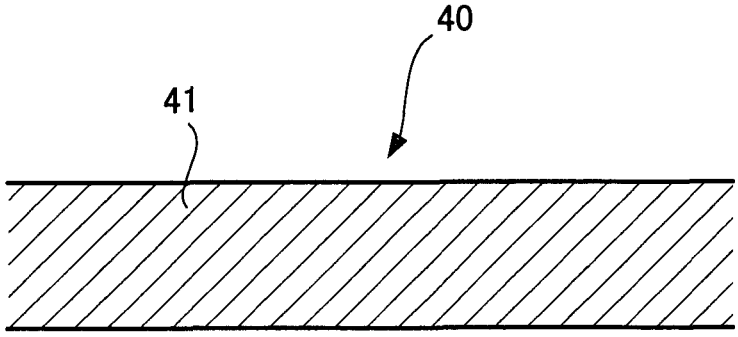
Fig. 4 RELATED ART
FIG. 4 is a schematic diagram showing an example of known exhaust gas treatment catalysts.
Figure 5:
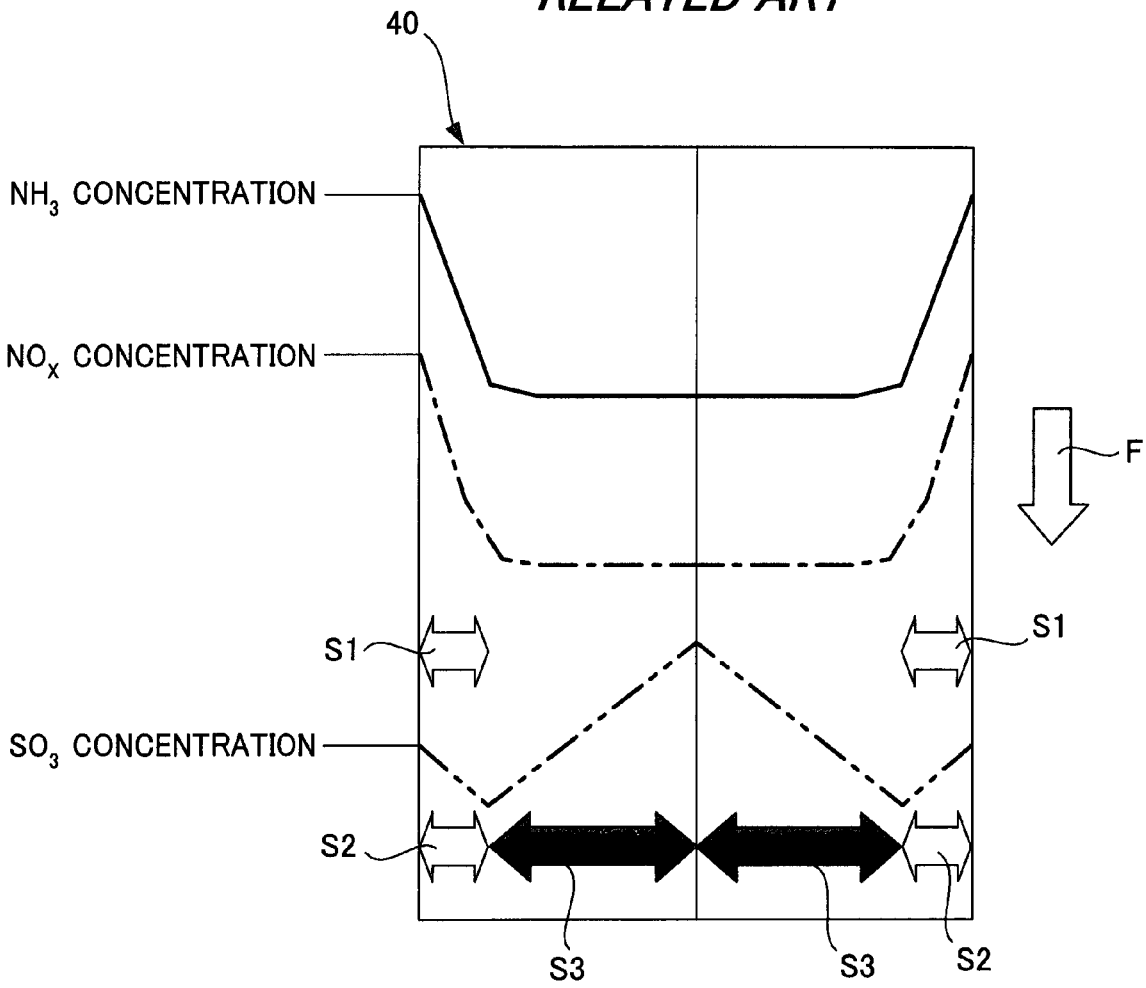
Fig. 5 RELATED ART
FIG. 5 is a schematic diagram showing the behavior of a $SO_3$ reduction reaction and a denitration reaction in a catalyst layer of a known exhaust gas treatment catalyst.
Figure 6:
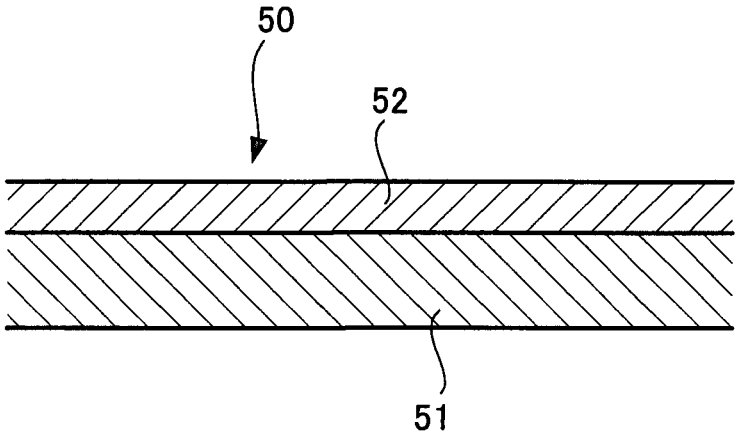
Fig. 6 RELATED ART
FIG. 6 is a schematic diagram showing another example of known exhaust gas treatment catalysts.
Figure 7:
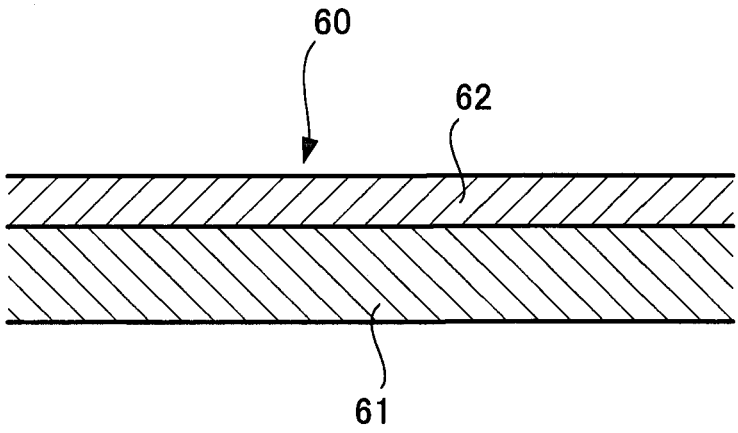
Fig. 7 RELATED ART
FIG. 7 is a schematic diagram showing another example of known exhaust gas treatment catalysts.

Here, examples of the exhaust gas treatment apparatus according to an aspect of the present invention include an exhaust gas treatment apparatus 20 merely including the above-described exhaust gas treatment catalyst 10, as shown in FIG. 2, and an exhaust gas treatment apparatus 30 including the above-described exhaust gas treatment catalyst 10 and a denitration catalyst 31 disposed in series with the exhaust gas treatment catalyst 10. Ammonia 22 is added to the exhaust gas 21 flowing into these exhaust gas treatment apparatuses 20 and 30. In the exhaust gas treatment apparatus 30, the exhaust gas treatment catalyst 10 is disposed in contact with the exhaust gas 21 after addition of ammonia 22, and the denitration catalyst 31 is disposed downstream from the exhaust gas treatment catalyst 10. For the denitration catalyst 31, a catalyst, which has been used previously, or a catalyst containing ruthenium is used. When a gas prepared by adding ammonia 22 to the exhaust gas 21 is allowed to flow into the exhaust gas treatment apparatus 20 or 30, oxidation of $SO_2$ in the exhaust gas to $SO_3$ is inhibited, and a reduction treatment of $SO_3$ in the exhaust gas to $SO_2$ and a denitration treatment are performed at the same time. That is, $SO_3$ in the exhaust gas is reduced by the exhaust gas treatment catalyst 10 so as to form $SO_2$ and, in addition, $NO_X$ is reduced so as to form nitrogen. Furthermore, $NO_X$ in the exhaust gas is further reduced by the denitration catalyst 31, so as to form nitrogen.

Consequently, as described above, one exhaust gas treatment apparatus 20 or 30 can effect the reduction reaction of sulfur trioxide and the reduction reaction of nitrogen oxides in the entire catalyst 10, and the formation reaction of sulfur trioxide can be inhibited. In this manner, miniaturization and cost reduction of the exhaust gas treatment apparatus can be facilitated.

In the present embodiment, the case where the present invention is applied to the catalyst which facilitates the reduction reaction of sulfur trioxide and the reduction reactions of nitrogen oxides has been described. However, the present invention is not limited to this. The present invention can be applied in a manner similar to that in the present embodiment insofar as the catalyst is an exhaust gas treatment catalyst, e.g., a $NO_X$-reducing catalyst or a $SO_X$-reducing catalyst, which removes one or more pollutants in an exhaust gas.

Example 1

Catalyst Preparation Method 1

A catalyst powder ($TiO_2$—$WO_3$) containing 10 parts by weight of tungsten oxide ($WO_3$) relative to 100 parts by weight of titania ($TiO_2$) and a ruthenium chloride ($RuCl_3$) solution were mixed to prepare a slurry. The resulting slurry was subjected to spray drying, and the resulting powder was allowed to support 2 parts by weight of ruthenium relative to 100 parts by weight of titania-tungsten oxide powder, followed by firing at 500° C. for 5 hours. The resulting titania-tungsten oxide-ruthenium powder was used as a powder catalyst (No. 1).

A mixture of 11 parts by weight of powder catalyst (No. 1), 79 parts by weight of $SiO_2$ (produced by Fuji Silysia Chemical Ltd.), 10 parts by weight of glass fiber serving as an inorganic binder, polyvinyl alcohol as an organic binder, and water was kneaded with a kneader.

The kneaded product was extruded into a honeycomb compact with a vacuum extruder having a screw provided with a honeycomb extrusion nozzle. The resulting compact was air-dried and, thereafter, forced-air drying was performed at 100° C. for 5 hours.

Subsequently, firing was performed at 500° C. for 5 hours so as to remove the organic binder.

An exhaust gas treatment catalyst (No. 1) taking a honeycomb shape having an outer diameter of 28.4 mm×28.4 mm, a length in axis direction of 600 mm, a cell pitch of 6.7 mm, an outer wall thickness of 1.1 mm, and an inner wall thickness of 0.6 mm was produced.

The resulting exhaust gas treatment catalyst (No. 1) contains 11 percent by weight of titania-tungsten oxide-ruthenium and 89 percent by weight of silica.

Example 2

Catalyst Preparation Method 2

A mixture of 6 parts by weight of powder catalyst (No. 1) prepared in Catalyst preparation method 1, 84 parts by weight of $SiO_2$ (produced by Fuji Silysia Chemical Ltd.), 10 parts by weight of glass fiber, polyvinyl alcohol as an organic binder, and water was kneaded with a kneader.

The following operations were performed as in Catalyst preparation method 1, so as to produce an exhaust gas treatment catalyst (No. 2) taking a honeycomb shape. The resulting exhaust gas treatment catalyst (No. 2) contains 6 percent by weight of titania-tungsten oxide-ruthenium and 94 percent by weight of silica.

Example 3

Catalyst Preparation Method 3

A mixture of 22 parts by weight of powder catalyst (No. 1) prepared in Catalyst preparation method 1, 68 parts by weight of $SiO_2$ (produced by Fuji Silysia Chemical Ltd.), 10 parts by weight of glass fiber, polyvinyl alcohol as an organic binder, and water was kneaded with a kneader.

The following operations were performed as in Catalyst preparation method 1, so as to produce an exhaust gas treatment catalyst (No. 3) taking a honeycomb shape. The resulting exhaust gas treatment catalyst (No. 3) contains 22 percent by weight of titania-tungsten oxide-ruthenium and 78 percent by weight of silica.

Example 4

Catalyst Preparation Method 4

A catalyst powder ($TiO_2$—$WO_3$) containing 10 parts by weight of tungsten oxide ($WO_3$) relative to 100 parts by weight of titania ($TiO_2$) and a ruthenium chloride ($RuCl_3$) solution were mixed to prepare a slurry. The resulting slurry was subjected to spray drying, and the resulting powder was allowed to support 4 parts by weight of ruthenium relative to 100 parts by weight of titania-tungsten oxide powder, followed by firing at 500° C. for 5 hours. The resulting titania-tungsten oxide-ruthenium powder was used as a powder catalyst (No. 2).

A mixture of 11 parts by weight of powder catalyst (No. 2), 79 parts by weight of $SiO_2$ (produced by Fuji Silysia Chemical Ltd.), 10 parts by weight of glass fiber, polyvinyl alcohol as an organic binder, and water was kneaded with a kneader.

The kneaded product was extruded into a honeycomb compact with a vacuum extruder having a screw provided with a honeycomb extrusion nozzle. The resulting compact was air-dried and, thereafter, forced-air drying was performed at 100° C. for 5 hours.

Subsequently, firing was performed at 500° C. for 5 hours so as to remove the organic binder.

An exhaust gas treatment catalyst (No. 4) taking a honeycomb shape having an outer diameter of 28.4 mm×28.4 mm, a length in axis direction of 600 mm, a cell pitch of 6.7 mm, an outer wall thickness of 1.1 mm, and an inner wall thickness of 0.6 mm was produced.

The resulting exhaust gas treatment catalyst (No. 4) contains 11 percent by weight of titania-tungsten oxide-ruthenium and 89 percent by weight of silica.

Example 5

Catalyst Preparation Method 5

A silica ($SiO_2$) powder and a ruthenium chloride ($RuCl_3$) solution were mixed to prepare a slurry. The resulting slurry was subjected to spray drying, and the resulting powder was allowed to support 2 parts by weight of ruthenium relative to 100 parts by weight of silica powder, followed by firing at 500° C. for 5 hours. The resulting silica-ruthenium powder was used as a powder catalyst (No. 3).

A mixture of 11 parts by weight of powder catalyst (No. 3), 79 parts by weight of $SiO_2$ (produced by Fuji Silysia Chemical Ltd.), 10 parts by weight of glass fiber serving as an inorganic binder, polyvinyl alcohol as an organic binder, and water was kneaded with a kneader.

The kneaded product was extruded into a honeycomb compact with a vacuum extruder having a screw provided with a honeycomb extrusion nozzle. The resulting compact was air-dried and, thereafter, forced-air drying was performed at 100° C. for 5 hours.

Subsequently, firing was performed at 500° C. for 5 hours so as to remove the organic binder.

An exhaust gas treatment catalyst (No. 5) taking a honeycomb shape having an outer diameter of 28.4 mm×28.4 mm, a length in axis direction of 600 mm, a cell pitch of 6.7 mm, an outer wall thickness of 1.1 mm, and an inner wall thickness of 0.6 mm was produced.

The resulting exhaust gas treatment catalyst (No. 5) contains 11 percent by weight of silica-ruthenium and 89 percent by weight of silica.

Example 6

Catalyst Preparation Method 6

A silica ($SiO_2$) powder and a ruthenium chloride ($RuCl_3$) solution were mixed to prepare a slurry. The resulting slurry was subjected to spray drying, and the resulting powder was allowed to support 4 parts by weight of ruthenium relative to 100 parts by weight of silica powder, followed by firing at 500° C. for 5 hours. The resulting silica-ruthenium powder was used as a powder catalyst (No. 4).

A mixture of 11 parts by weight of powder catalyst (No. 4), 79 parts by weight of $SiO_2$ (produced by Fuji Silysia Chemical Ltd.), 10 parts by weight of glass fiber, polyvinyl alcohol as an organic binder, and water was kneaded with a kneader.

The kneaded product was extruded into a honeycomb compact with a vacuum extruder having a screw provided with a honeycomb extrusion nozzle. The resulting compact was air-dried and, thereafter, forced-air drying was performed at 100° C. for 5 hours.

Subsequently, firing was performed at 500° C. for 5 hours so as to remove the organic binder.

An exhaust gas treatment catalyst (No. 6) taking a honeycomb shape having an outer diameter of 28.4 mm×28.4 mm, a length in axis direction of 600 mm, a cell pitch of 6.7 mm, an outer wall thickness of 1.1 mm, and an inner wall thickness of 0.6 mm was produced.

The resulting exhaust gas treatment catalyst (No. 6) contains 11 percent by weight of silica-ruthenium and 89 percent by weight of silica.

Comparative Example 1

Comparative Catalyst Preparation Method 1

A honeycomb catalyst containing 10 parts by weight of tungsten oxide ($WO_3$) relative to 100 parts by weight of titania ($TiO_2$) was impregnated with a ruthenium chloride ($RuCl_3$) solution, so that the resulting powder was allowed to support by impregnation 1 part by weight of Ru relative to 100 parts by weight of titania-tungsten oxide catalyst. For example, when the water content of the titania-tungsten oxide honeycomb catalyst is 0.25 ml relative to 1 g of catalyst, the concentration of ruthenium chloride solution is calculated as described below, in order that 1 part by weight of ruthenium relative to 100 parts by weight of titania-tungsten oxide honeycomb catalyst is supported by impregnation.

$$0.01\times1/0.25=0.04\ g/ml=40\ g/l$$

Therefore, 100 parts by weight of honeycomb catalyst is impregnated with 1 part by weight of ruthenium by immersing the catalyst in the solution, in which the Ru concentration in the ruthenium chloride ($RuCl_3$) solution is adjusted to be 40 g/L, for 1 minute.

The titania-tungsten oxide catalyst supporting ruthenium by impregnation was dried and fired at 500° C. for 5 hours.

The resulting titania-tungsten oxide-ruthenium catalyst had the same shape as that in Example, and was used as a comparative exhaust gas treatment catalyst (No. 1).

Comparative Example 2

Comparative Catalyst Preparation Method 2

A mixture of 11 parts by weight of powder catalyst (No. 1) prepared in the above-described Catalyst preparation method 1, 79 parts by weight of $TiO_2$ (MC-90 produced by ISHIHARA SANGYO KAISHA, Ltd.), 10 parts by weight of glass fiber, polyvinyl alcohol as an organic binder, and water was kneaded with a kneader.

The following operations were performed as in the above-described Catalyst preparation method 1, so as to produce a comparative exhaust gas treatment catalyst (No. 2) having the same shape as that in Example 1.

The resulting comparative exhaust gas treatment catalyst (No. 2) contains 11 percent by weight of titania-tungsten oxide-ruthenium and 89 percent by weight of titania and glass fiber.

Comparative Example 3

Comparative Catalyst Preparation Method 3

Water was added to the powder catalyst (No. 1) prepared in the above-described Catalyst preparation method 1, and wet grinding with balls was performed, so as to prepare a coating slurry.

The honeycomb catalyst containing 9 parts by weight of tungsten oxide ($WO_3$) relative to 100 parts by weight of titania ($TiO_2$) to be used as a base material was immersed in the above-described slurry, and after drying, firing was performed at 500° C. for 5 hours.

The amount of coating (amount of application) of the grinding slurry was 100 g per square meter of surface area of the base material, and a comparative exhaust gas treatment catalyst (No. 3) having the same shape as that in the above-described Example 1 was produced.

Evaluation Experiment

Evaluation of $SO_3$ Reduction Performance and Denitration Performance

Each of the above-described exhaust gas treatment catalysts (No. 1 to No. 6) and comparative exhaust gas treatment catalysts (No. 1 and No. 2) was formed into the shape shown in Table 1, that is, the catalyst of 28.4 mm (4 holes)×28.4 mm (4 holes)×600 mm long was formed. Two units of the thus formed catalysts were connected in series. An exhaust gas was allowed to flow through each of the exhaust gas treatment catalysts (No. 1 to No. 6) and the comparative exhaust gas treatment catalysts (No. 1 and No. 2) taking the above-described shape under the condition as shown in the following Table 1. The $SO_3$ reduction efficiency and the denitration efficiency were measured at each of the outlet of the first unit (AV=37.2 $m^3N/m^2\cdot h$) of the catalyst and the outlet of the second unit (AV=18.6 $m^3N/m^2\cdot h$). In Table 1, Ugs represents a superficial velocity (flow rate of fluid/cross-sectional area of f honeycomb catalyst), and AV represents an areal velocity (gas flow rate/total contact area of catalyst).

TABLE 1

| | |
|---|---|
| Catalyst shape | 28.4 mm (4 holes) × 28.4 mm (4 holes) × 600 mm long × 2 units |
| Gas flow rate | 8.71 $m^3N/h$ |
| Ugs | 3.0 mN/sec |
| AV | 37.2 $m^3N/m^2 \cdot h$ (outlet of first unit)<br>18.6 $m^3N/m^2 \cdot h$ (outlet of second unit) |
| Gas temperature | 380° C. |
| Gas property | NOx: 350 ppm<br>$NH_3$: 420 ppm<br>SOx: 1,500 ppm<br>$SO_3$: 30 ppm<br>$O_2$: 3.5%<br>$CO_2$: about 14%<br>$H_2O$: about 13%<br>$N_2$: balance |

The results of measurement based on the above-described Table 1 are shown in the following Table 2.

In Table 2, the $SO_3$ reduction efficiency and the denitration efficiency were represented by the following formulae, respectively.

$$SO_3 \text{ reduction efficiency}(\%)=(1-\text{outlet } SO_3 \text{ concentration/inlet } SO_3 \text{ concentration})\times 100$$

$$\text{denitration efficiency}(\%)=(1-\text{outlet } NO_X \text{ concentration/inlet } NO_X \text{ concentration})\times 100$$

tion performance or the $SO_3$ reduction performance. As is clear from the measurement results of the above-described exhaust gas treatment catalysts and the above-described comparative exhaust gas treatment catalysts, with respect to the catalyst merely composed of a $TiO_2$—$WO_3$—Ru powder having $SO_3$ reduction performance, the oxidation reaction of $SO_2$ to $SO_3$ becomes dominant as compared with the reduction reaction of $SO_3$ to $SO_2$, and the $SO_3$ reduction performance is not exhibited. Furthermore, when dilution is performed with the powder, e.g., anatase type titania, having the denitration performance as well, the $SO_3$ reduction performance is not exhibited.

Evaluation of susceptibility to poisoning by arsenic

Here, the susceptibility of the catalyst to poisoning by arsenic was evaluated with respect to each of the exhaust gas treatment catalyst (No. 1) according to Example 1 of the present invention and the comparative exhaust gas treatment catalyst (No. 3), and comparison of the susceptibility was carried out.

That is, the $SO_3$ reduction efficiency and the denitration efficiency of the above-described exhaust gas treatment catalyst (No. 1) and the above-described comparative exhaust gas treatment catalyst (No. 3) were measured under the exhaust gas condition shown in the above-described Table 1. After arsenic oxide ($As_2O_3$) was injected into the exhaust gas at a concentration of 4 ppm for 8 hours (a treatment under a specific condition was performed), the $SO_3$ reduction efficiency and the denitration efficiency were measured again. The measurement results are shown in the following Table 3.

TABLE 2

| | | | | | AV = 37.2 (first unit outlet) | | | AV = 18.6 (second unit outlet) | | |
|---|---|---|---|---|---|---|---|---|---|---|
| Type of catalyst | | Catalyst powder | Diluent powder | Ratio of catalyst powder (%) | $SO_3$ reduction efficiency (%) | Denitration efficiency (%) | $NH_3$ concentration (ppm) | $SO_3$ reduction efficiency (%) | Denitration efficiency (%) | $NH_3$ concentration (ppm) |
| Exhaust gas treatment catalyst | 1 | ($TiO_2$—$WO_3$):Ru = 100:2 | $SiO_2$ | 11 | 15.5 | 32.6 | 304 | 21.1 | 51.7 | 168 |
| | 2 | ($TiO_2$—$WO_3$):Ru = 100:2 | $SiO_2$ | 6 | 9.8 | 22.6 | 339 | 16.4 | 39.1 | 270 |
| | 3 | ($TiO_2$—$WO_3$):Ru = 100:2 | $SiO_2$ | 22 | 16.4 | 37.4 | 267 | 22.8 | 66.6 | 111 |
| | 4 | ($TiO_2$—$WO_3$):Ru = 100:4 | $SiO_2$ | 11 | 14.4 | 28.0 | 301 | 29.8 | 49.0 | 182 |
| | 5 | ($SiO_2$:Ru = 100:2 | $SiO_2$ | 11 | 11.0 | 0.3 | 407 | 16.4 | 1.1 | 384 |
| | 6 | ($SiO_2$:Ru = 100:4 | $SiO_2$ | 11 | 11.0 | 0 | 403 | 18.4 | 0 | 361 |
| Comparative exhaust gas treatment catalyst | 1 | ($TiO_2$—$WO_3$):Ru = 100:1 | — | 100 | −2.3 | 58.3 | 157 | −55.1 | 82.1 | 28 |
| | 2 | ($TiO_2$—$WO_3$):Ru = 100:2 | $TiO_2$ | 11 | −29.3 | 63.1 | 143 | −131 | 86.9 | 29 |

As is clear from the results shown in Table 2, the exhaust gas treatment catalyst according to an aspect of the present invention has the $SO_3$ reduction performance and the denitra-

TABLE 3

| | Before poisoning by arsenic | | | | After poisoning by arsenic | | | |
|---|---|---|---|---|---|---|---|---|
| | AV = 37.2 (first unit outlet) | | AV = 18.6 (second unit outlet) | | AV = 37.2 (first unit outlet) | | AV = 18.6 (second unit outlet) | |
| Type of catalyst | $SO_3$ reduction efficiency (%) | Denitration efficiency (%) | $SO_3$ reduction efficiency (%) | Denitration efficiency (%) | $SO_3$ reduction efficiency (%) | Denitration efficiency (%) | $SO_3$ reduction efficiency (%) | Denitration efficiency (%) |
| Exhaust gas treatment catalyst (No. 1) | 15.5 | 32.6 | 21.1 | 51.7 | 7.1 | 23.6 | 9.3 | 37.7 |

TABLE 3-continued

| Type of catalyst | Before poisoning by arsenic | | | | After poisoning by arsenic | | | |
|---|---|---|---|---|---|---|---|---|
| | AV = 37.2 (first unit outlet) | | AV = 18.6 (second unit outlet) | | AV = 37.2 (first unit outlet) | | AV = 18.6 (second unit outlet) | |
| | $SO_3$ reduction efficiency (%) | Denitration efficiency (%) | $SO_3$ reduction efficiency (%) | Denitration efficiency (%) | $SO_3$ reduction efficiency (%) | Denitration efficiency (%) | $SO_3$ reduction efficiency (%) | Denitration efficiency (%) |
| Comparative exhaust gas treatment catalyst (No. 3) | 25.6 | 67.0 | 20.0 | 87.1 | −3.6 | 56.0 | −11.1 | 78.8 |

As is clear from the results shown in Table 3, before poisoning by arsenic, the exhaust gas treatment catalyst according to an aspect of the present invention has the $SO_3$ reduction performance and the denitration performance inferior to those of the comparative exhaust gas treatment catalyst (No. 3), but the $SO_3$ reduction performance before poisoning by arsenic is maintained after the poisoning by arsenic, whereas the comparative exhaust gas treatment catalyst (No. 3), which is susceptible to poisoning under a general condition, does not exhibit the $SO_3$ reduction performance after the above-described treatment under a specific condition. Consequently, it is clear that the exhaust gas treatment catalyst according to an aspect of the present invention is less affected by the poisoning of arsenic, the $SO_3$ reduction performance and the denitration performance are satisfactorily delivered even in the case where arsenic is present in the exhaust gas and, therefore, the exhaust gas treatment catalyst of the invention is suitable for use in the exhaust gas treatment.

That is, it is clear that according to the above-described exhaust gas treatment catalyst 10, since the $SO_3$-reducing catalyst powder 11 and the diluent powder 12 are included and the $SO_3$-reducing catalyst powder 11 is dispersed in the diluent powder 12, the diluent powder 12 can adsorb poisons from the exhaust gas, diluting the impact of the poisons on the $SO_3$-reducing catalyst powder 11.

Since the $SO_3$ concentration and the $NO_X$ concentration in the exhaust gas can be reduced, the present invention is useful for application to an exhaust gas treatment of a boiler in which coal, heavy oil, or the like having a high sulfur content is burned as a fuel.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust gas treatment catalyst for removal of one or more pollutants in an exhaust gas containing $NO_X$ and $SO_3$, the catalyst comprising:

a catalytic powder which removes $NO_X$ and $SO_3$; and a diluent powder which is not a catalyst for exhaust gas reactions nor a catalyst for reactions between exhaust gas components and a reagent, wherein the catalyst containing both a catalytic powder and a diluent powder is extruded into a honeycomb;

wherein the catalytic powder is dispersed in the diluent powder; and wherein said diluent powder adsorbs poisons emitted from coal, heavy oil or fuel oil C.

2. The exhaust gas treatment catalyst according to claim 1, wherein the catalytic powder reduces sulfur trioxide with an ammonia reagent.

3. The exhaust gas treatment catalyst according to claim 2, wherein the catalytic powder comprises (1) titania-tungsten oxide or silica, and (2) ruthenium.

4. The exhaust gas treatment catalyst according to claim 3, wherein ruthenium is 0.1 parts by weight or more, and 10 parts by weight or less relative to 100 parts by weight of titania-tungsten oxide or silica.

5. The exhaust gas treatment catalyst according to any one of claim 1 to claim 4, wherein the diluent powder is silica.

6. The exhaust gas treatment catalyst according to any one of claim 1 to claim 4, wherein the content of the catalytic powder in the exhaust gas treatment catalyst is 1% or more, and 50% or less.

7. The exhaust gas treatment catalyst according to claim 5, wherein the content of the catalytic powder in the exhaust gas treatment catalyst is 1% or more, and 50% or less.

8. An exhaust gas treatment method for removing nitrogen oxides and sulfur trioxide contained in an exhaust gas, the method comprising the step of:

allowing the exhaust gas after addition of ammonia to come into contact with the exhaust gas treatment catalyst according to claim 3, so as to reduce the sulfur trioxide and reduce the nitrogen oxides.

9. An exhaust gas treatment apparatus for removing nitrogen oxides and sulfur trioxide contained in an exhaust gas, wherein the exhaust gas treatment apparatus is disposed in contact with the exhaust gas after addition of ammonia and includes the exhaust gas treatment catalyst according to claim 3, so as to reduce the sulfur trioxide and reduce the nitrogen oxide through the use of the exhaust gas treatment catalyst.

10. The exhaust gas treatment apparatus according to claim 9, wherein the exhaust gas treatment apparatus further comprises a denitration catalyst disposed downstream from the exhaust gas treatment catalyst, so as to further reduce the nitrogen oxides through the use of the denitration catalyst.

11. An exhaust gas treatment catalyst for removal of one or more pollutants in an exhaust gas containing $NO_X$ and $SO_3$, the catalyst comprising:

a catalytic powder which removes $NO_X$ and $SO_3$; and a diluent powder which is not a catalyst for exhaust gas reactions nor a catalyst for reactions between exhaust gas components and a reagent, wherein the catalyst containing both a catalytic powder and a diluent powder is extruded into a honeycomb;

wherein the catalytic powder is dispersed in the diluent powder;

wherein said diluent powder adsorbs poisons; and wherein said diluent powder is silica.

* * * * *